United States Patent [19]

Miller et al.

[11] Patent Number: 5,061,217

[45] Date of Patent: Oct. 29, 1991

[54] TOY FOAM PLASTIC GLIDER WITH DETACHABLE PYLON WINGS

[76] Inventors: Jack V. Miller; Ruth E. Miller, both of 700 N. Auburn Ave., Sierra Madre, Calif. 91024

[21] Appl. No.: 550,283

[22] Filed: Jul. 9, 1990

[51] Int. Cl.[5] ..... A63H 27/00; A63H 3/46

[52] U.S. Cl. ..... 446/61; 446/390

[58] Field of Search ..... 446/61, 34, 66, 97, 446/99, 62–65, 68, 376, 390

[56] References Cited

U.S. PATENT DOCUMENTS

| | | | |
|---|---|---|---|
| 3,176,988 | 4/1965 | De Ferdinando | 446/61 X |
| 3,293,793 | 12/1966 | Thomas, Jr. | 446/65 |
| 3,787,998 | 1/1974 | Kilroy, Jr. et al. | 446/61 |
| 4,109,411 | 8/1978 | Wgtherell et al. | 446/61 |
| 4,233,773 | 11/1980 | Jones | 446/34 X |

*Primary Examiner*—Mickey Yu

[57] ABSTRACT

A toy glider in the form of an animal figure has an animal body form fuselage including a longitudinal axis, generally parallel sides, a front end and a rear end. A pair of wings in the form of animal wings are attached to the fuselage in a horizontal plane parallel to the longitudinal axis of the fuselage. A nose section in the form of an animal head and attached to the front end of the fuselage and a tail section is attached to the rear end of the fuselage. A wing in the form of a pair of animal wings has a depending pylon, matingly engageable and latched into the aperture of the fuselage, and including a means for disengaging the wing pylon from the fuselage to permit use of the toy as an animal form without the wings. A plug is provided to close off the aperture in the fuselage when the wings are removed.

7 Claims, 3 Drawing Sheets

TOY FOAM PLASTIC GLIDER WITH DETACHABLE PYLON WINGS

BACKGROUND OF THE INVENTION

This invention relates to the field of toy gliders, and more specifically to reconfigurable toy gliders that may be transformed into a variety of flyable and non-flyable configurations, such as shown in my co-pending applications Ser. No. 331,774 entitled RECONFIGURABLE ANIMAL FIGURE TOY GLIDER, Ser. No. 512,769 entitled RECONFIGURABLE TOY GLIDER, and other co-pending applications entitled TOY GLIDER HAVING VARIABLE DIHEDRAL WINGS and TOY FOAM PLASTIC GLIDER WITH FLEXIBLE APPENDAGES.

A primary purpose of the present invention is to provide a toy glider in the form of animal figure that is reconfigurable from a gliding flight configuration to a toy animal configuration without wings, thereby providing greatly enhanced play value in addition to the use as a toy glider. The invention transforms a limited-use glider into an animal toy by removing the wings to provide an animal figure that may be used in play without the wings.

SUMMARY OF THE INVENTION

A toy glider invention is in the form of an animal figure having a fuselage in the form of a symmetrical animal body having a longitudinal axis, generally parallel sides, a front end and a rear end. The fuselage has a longitudinally elongated aperture on the vertical plane, extending through the form of the animal body. A wing in the form of a pair of animal wings generally in the horizontal plane has contiguous wing roots at an integral depending pylon which is matingly engageable into the aperture of the fuselage. A nose section generally in the form of an animal head is at the front end of the fuselage, a tail section empennage is at the rear end of the fuselage, and one or more limb-simulating appendages extend from a surface of the fuselage.

A means is provided for retaining the pylon of the wing section in the fuselage to operate the toy as a glider, and for disengaging the wing pylon from the fuselage to permit use of the toy as an animal form without the wings. In a preferred embodiment the depending wing section pylon has a centrally located tapered slot dividing the pylon into two tapered cantelevered beams of approximately constant stress, each of beams extending from the wing roots at a top surface of the fuselage to a tip of each beam, flush with a lower surface of the hole through the fuselage, and having an integral latch at its tip that engages into the recess of the hole. The latch is provided with a depending tab that is manually depressed to disengage said latch from the recess, thereby permitting removal of the wing section from the fuselage for use of the animal body as a non-flying toy.

BRIEF DESCRIPTION OF THE DRAWINGS

FIG. 3 is a partial cross-sectional side elevation view of the glider of FIG. 1, taken along section line 2—2 of FIG. 1 and showing the wing section being unlatch for removal of the wings;

DETAILED DESCRIPTION OF THE DRAWINGS

Figure 1:
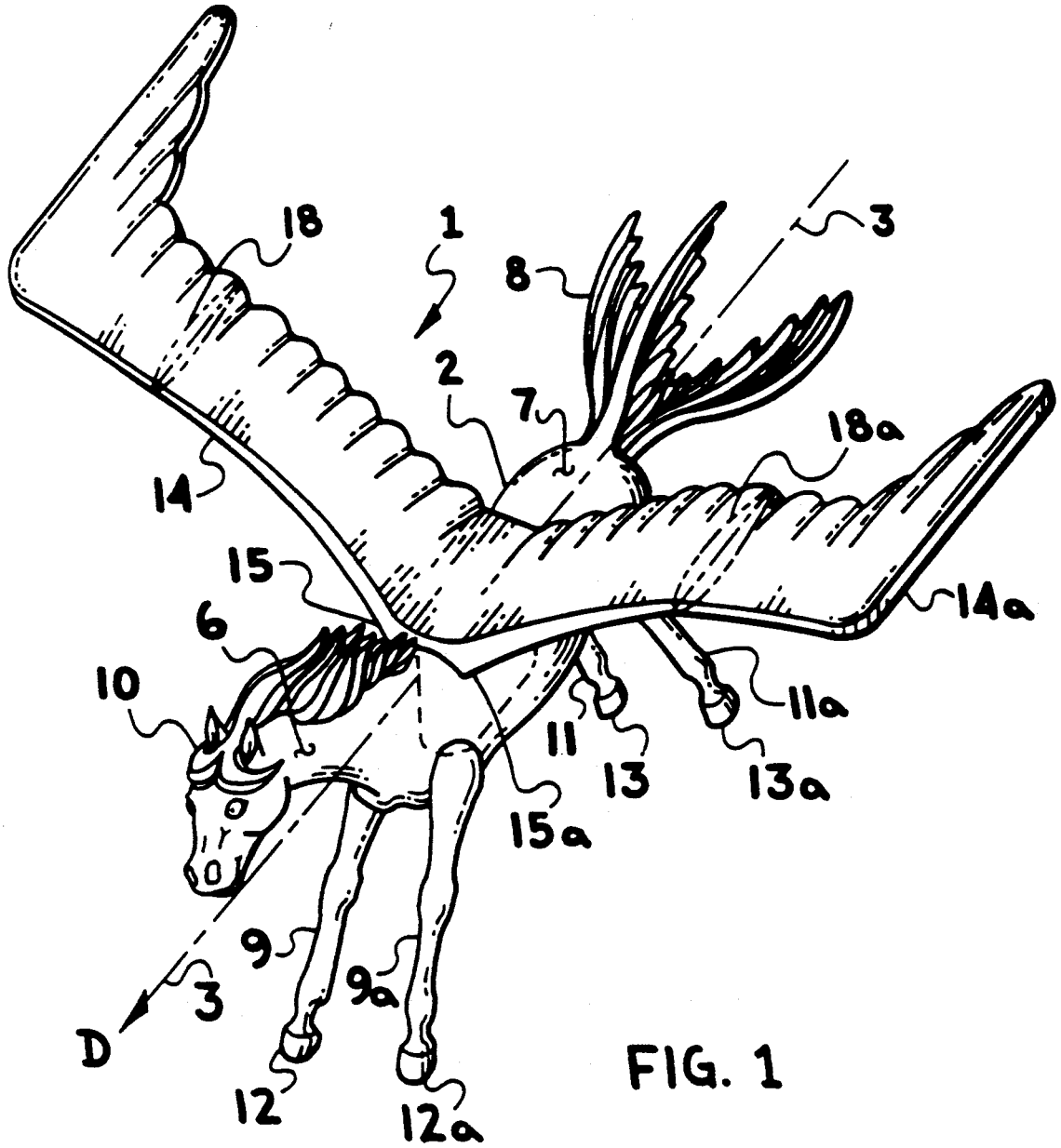
FIG. 1 is a perspective view of a toy glider according to a preferred embodiment of the invention in the form of an animal figure in a flying configuration.

In FIG. 1 the toy glider 1 in the form of an animal figure according to the invention is shown in the form of a molded foam plastic flying horse, or Pegasus in normal level flying configuration, in which a fuselage 2, shown in the form of a horse torso, is elongated along a flight axis 3. The fuselage has a front end 6 including a simulated animal head 10, and a rear end 7 adapted for attachment of a tail empennage section 8. Front end 6 is adapted for the attachment of front legs 9 and 9*a*, respectively, and rear end 7 is adapted for the attachment of rear legs 11 and 11*a*. The simulated animal legs 9, 9*a*, 11 and 11*a* are provided with simulated animal feet 12, 12*a*, 13 and 13*a*, respectively, in a standing posture generally in the horizontal plane. Fuselage 2 is further provided with a pair of wings 14 and 14*a*, joined contiguously at roots 15 and 15*a*, said wings being generally planar and disposed generally in a horizontal plane above the fuselage and being provided with areas with cross-sectional airfoil shapes having their aerodynamic chords 18 and 18*a*, respectively, configured for flight in direction D.

Figure 2:
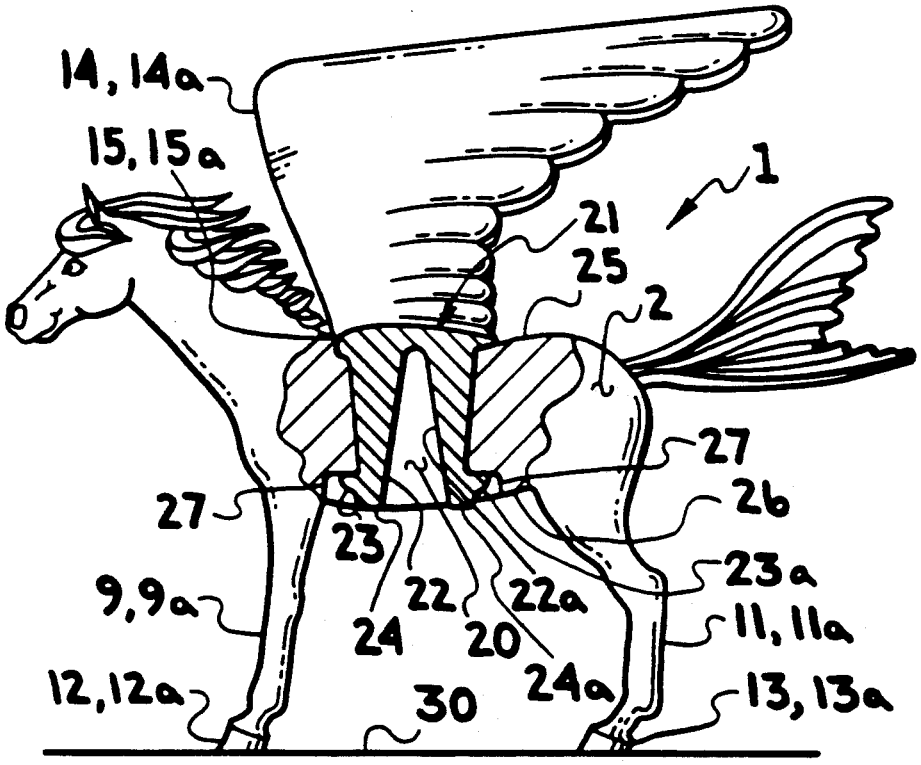
FIG. 2 is a partial cross-sectional side elevation view of the glider of FIG. 1, taken along section line 2—2 of FIG. 1 and showing the wing section latched in place in the fuselage.

In FIG. 2 the toy glider 1 of FIG. 1 is shown standing in a quadruped position on a generally horizontal surface 30 supported by legs 9, 9*a*, 11, and 11*a* on feet portions 12, 12*a*, 13 and 13*a*, respectively. The fuselage 2, simulating a horse torso, is shown in a partial cross-sectional view in which a longitudinally elongated hole 20 is shown extending vertically through fuselage 2 from a top surface 25 to a bottom surface 26, and including a recess 27 around hole 20 adjacent the bottom surface 26. Wing roots 15 and 15*a* are joined contiguously with a longitudinally elongated depending pylon 21, which extends from the wing roots at top surface 25 to the bottom surface 26 of the torso 2. Pylon 21 is divided into two depending tapered cantilever beams 22 and 22*a* which are engaged into slot 20 with a pair of latches 23 and 23*a* engaged into recess 27. Latches 23 and 23*a* are provided with tabs 24 and 24*a*, respectively.

Figure 3:
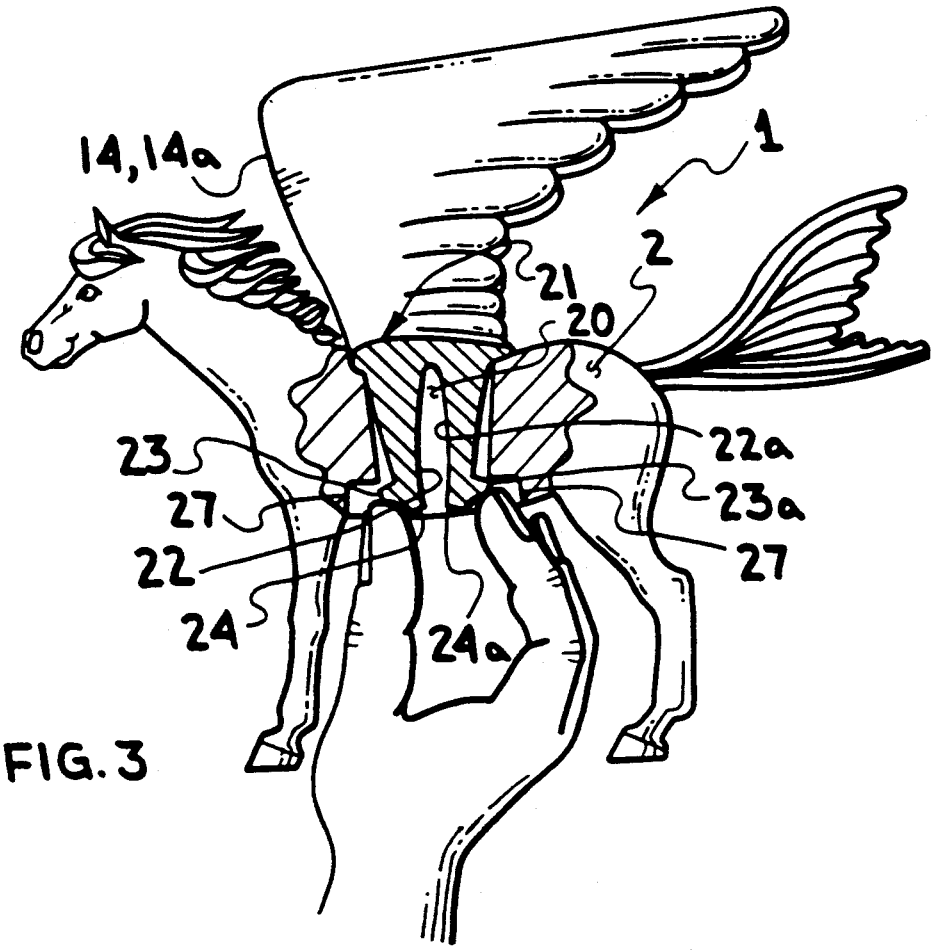
FIG. 3 is a partial cross-sectional side elevation view of the glider of FIG. 1, taken along section line 2—2 of FIG. 1

In FIG. 3 the toy glider 1 of FIG. 1 is shown having fuselage 2, simulating a horse torso, is shown in a partial cross-sectional view in which a the beams 22 and 22*a* are tapered to comprise beams of approximately uniform stress. The latches 23 and 23*a* are provided with tabs 24 and 24*a*, which are accessible to be flexed with fingers to release the latches 23 and 23*a* from engagement with recess 27, permitting the wings and wing pylon 21 to be removed from the elongated hole 20 of torso 2.

Figure 4:
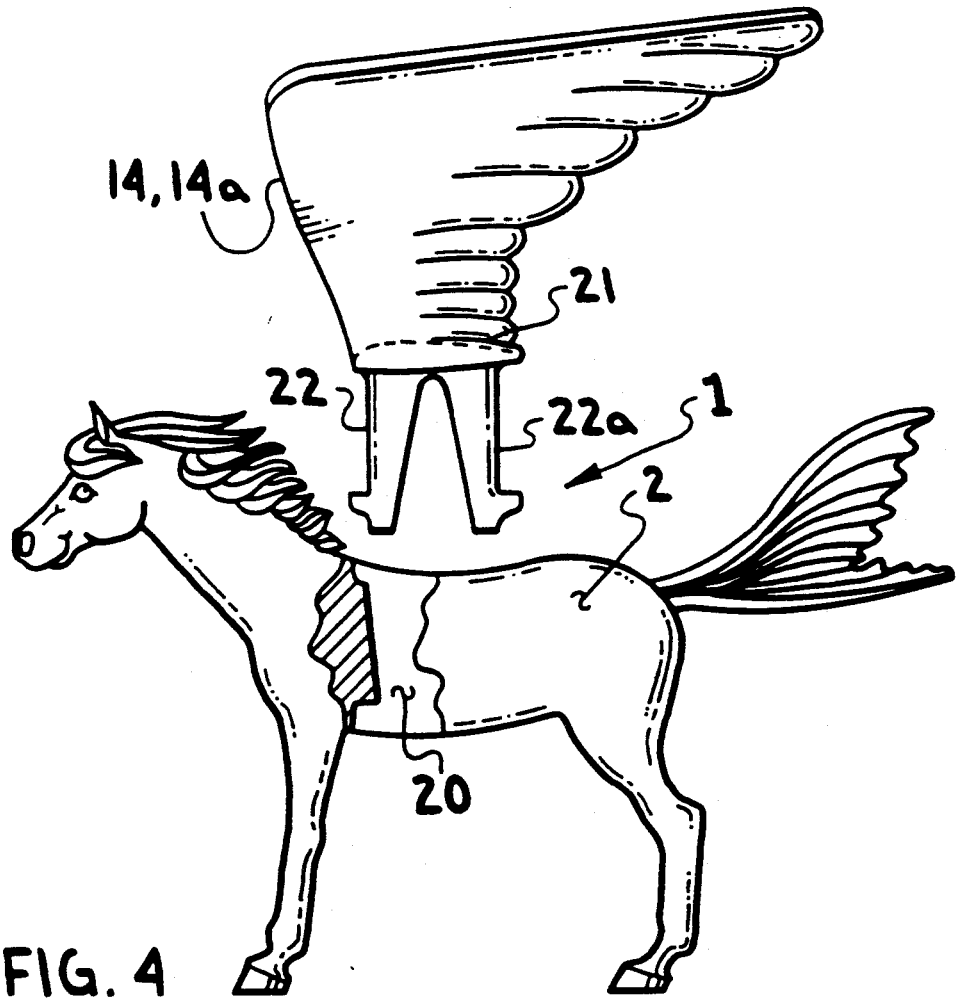
FIG. 4 is side elevation view of the glider of FIG. 1, showing the wing section removed for use as a non-flying animal toy.

In FIG. 4 the toy glider 1 of FIG. 1 is shown having wings 14 and 14*a*, along with the integral pylon 21 removed from the fuselage simulating an animal torso 2, by withdrawing depending beams 22 and 22*a* from engagement with elongated hole 20. With the wings removed, the glider functions as an animal toy.

Figure 5:
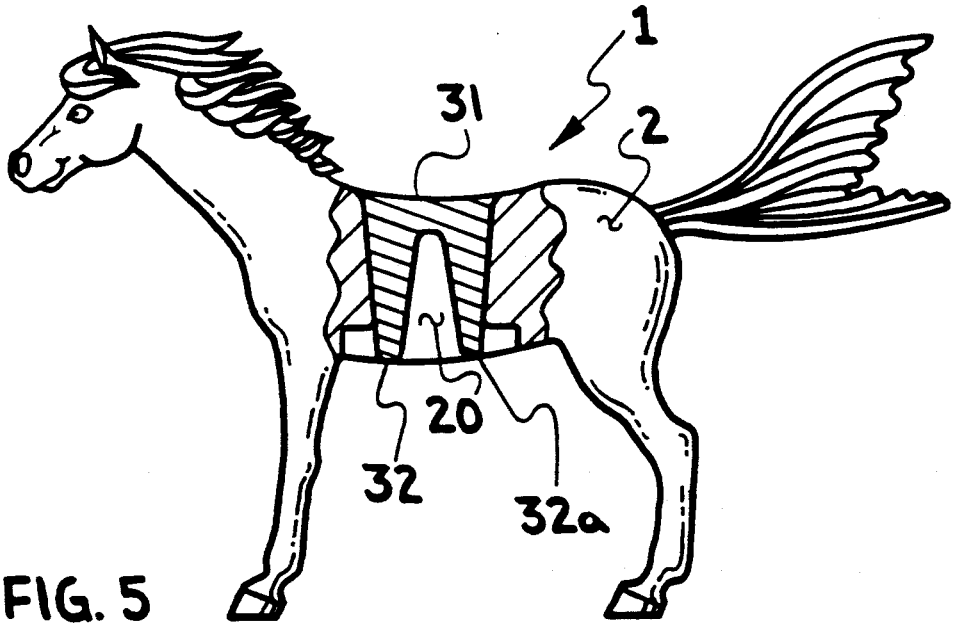
FIG. 5 is a a partial cross-sectional side elevation view of the glider of FIG. 4, showing a plug in place of the wing section.

In FIG. 5 the toy glider 1 of FIG. 1 is shown having fuselage 2, simulating a horse torso, is shown in a partial cross-sectional view in which a plug 31 is installed in the elongated hole 20 in the fuselage 2. Beams 32 and 32*a* are tapered to comprise beams of approximately uniform stress, resilintly urged into mating engagement in frictional contact with the elongated hole 20 of torso 2.

The primary purposes of the invention, to provide a toy glider in the form of an animal figure with removable wings, is achieved by the invention as shown and described herein. The invention illustrates a set of proportions selected to most clearly demonstrate the functions of the toy. It is obvious that many variations may be used to produce substantially the same result. The aesthetic design of the horse form shown in the drawings is not to be construed as limiting the scope of the invention to the horse or pony figures illustrated, but many other forms may be adapted to the structure of the invention within the scope of the claims.

We claim:

1. A toy glider in the form of a molded foam plastic animal figure comprising:

an elongated fuselage generally symmetrical about a vertical plane, having a longitudinal axis, generally parallel sides, a front end and a rear end, when said toy glider is in a normal horizontal flight orientation, the fuselage being generally in the form of an animal torso;

a non-circular aperture on the vertical plane through the fuselage;

a wing in the form of a pair of animal wings generally in the horizontal plane and having contiguous wing roots at an integral, non-circular depending pylon, matingly engageable into the aperture of the fuselage, said wings having portions comprising a generally planar airfoil cross-sectional shape with a mean aerodynamic chord of the airfoils being approximately parallel to the longitudinal axis of the fuselage;

a nose section generally in the form of an animal head at the front end of the fuselage;

a tail section empennage at the rear end of the fuselage;

one or more limb-simulating appendages extending from a surface of the fuselage; and a means for retaining the pylon of the wing section in the fuselage to operate the toy as a glider, and a means for disengaging the wing pylon from the fuselage to permit use of the toy as an animal form without the wings.

2. A toy glider according to claim 1 in which the aperture through the fuselage is a longitudinally elongated hole, and the pylon of the wing section is a longitudinally elongated depending beam frictionally engageable into said hole in the fuselage.

3. A toy glider according to claim 2 in which the depending wing pylon has a centrally located tapered slot dividing the pylon into two tapered cantelevered beams of approximately constant stress, each of said beams extending from the wing roots at a top surface of the fuselage to a tip of each beam being flush with a lower surface of the hole through said fuselage.

4. A toy glider according to claim 3 in which the lower surface of the fuselage is provided with a recess adjacent to the hole, and one or more of the beams of the wing pylon has an integral latch at its tip that engages into the recess of the hole.

5. A toy glider according to claim 4 in which the latch is provided with a depending tab that is manually depressed to disengage said latch from the recess, thereby permitting removal of the wing section from the fuselage.

6. A toy glider according to claim 5 in which the wing section and pylon is removed from the glider to permit use of the toy as an animal form without the wings, and including an elongated non-circular depending plug matingly engageable into the aperture of the fuselage and having a means for retaining said plug therein.

7. A toy glider according to claim 6 in which the means for retaining the plug is frictional engagement with the hole in the fuselage.

* * * * *